United States Patent [19]

Barnhard, IV et al.

[11] 4,058,420

[45] Nov. 15, 1977

[54] AQUEOUS SLURRY EXPLOSIVES WITH COLLOIDAL HYDROUS METAL OXIDE

[75] Inventors: Phillip Barnhard, IV, Provo, Utah; Francis John Kieres, Shenandoah, Pa.

[73] Assignee: IMC Chemical Group, Inc., Terre Haute, Ind.

[21] Appl. No.: 750,038

[22] Filed: Dec. 13, 1976

[51] Int. Cl.[2] ..... C06B 45/00

[52] U.S. Cl. ..... 149/2; 149/37; 149/41; 149/43; 149/44; 149/45; 149/60; 149/61

[58] Field of Search ..... 149/2, 46, 60, 37, 44, 149/41, 45

[56] References Cited

U.S. PATENT DOCUMENTS

| | | | |
|---|---|---|---|
| 3,212,944 | 10/1965 | Lyon et al. | 149/46 X |
| 3,223,478 | 12/1965 | Wilson | 149/46 |

*Primary Examiner*—Stephen J. Leghert, Jr.
*Attorney, Agent, or Firm*—E. A. Figg; H. E. Post

[57] ABSTRACT

Improved thickened aqueous slurry explosives of the type containing an inorganic oxidizing salt, a fuel, and water are disclosed, wherein the improvement includes the use of a colloidal hydrous metal oxide as a thickening agent.

26 Claims, No Drawings

AQUEOUS SLURRY EXPLOSIVES WITH COLLOIDAL HYDROUS METAL OXIDE

BACKGROUND OF THE INVENTION

This invention relates to improved aqueous slurry explosives and to a method for their preparation. More particularly, the invention relates to thickened aqueous slurry explosives of the type comprising an inorganic oxidizing salt, an organic or inorganic fuel, water, and a thickening agent.

Aqueous slurry explosives are well known and have been widely accepted by users of commercial explosives. Such explosives generally contain a wide variety of ingredients. For instance, a slurry usually contains an inorganic oxidizing salt such as ammonium nitrate or an alkali or alkaline earth metal nitrate, e.g. sodium nitrate, or corresponding perchlorate salts or mixtures thereof. Organic and inorganic fuels are also often incorporated into such slurries. Organic fuels suitable for explosive slurries include a large variety of finely divided non-explosive carbonaceous materials such as carbon black, ground coal, fuel oils, vegetable oils, wax, wood pulp, vegetable pulp, sugar, nut meal, bagasse, etc. Inorganic fuels include finely divided metals and metal alloys such as aluminum, magnesium, and alloys thereof. Explosive slurries may optionally contain explosive sensitizers, depending upon the type of blasting agent desired. If a sensitizer is desired, such self-explosive materials as nitrostarch, trinitrotoluene (TNT), pentaerythritol tetranitrate (PETN), nitrocellulose, cyclotrimethylene trinitramine (RDX) and mixtures thereof may advantageously be employed.

Aqueous explosive slurries are generally thickened or gelled. Thickening serves to prevent segregation of the ingredients, to prevent leaks from containers having small perforations, to inhibit evaporation of liquids and to provide a resilient product when filled into elastic casings. Heretofore, aqueous slurries have been thickened with materials such as water soluble polysaccharides, e.g. methylcellulose, natural starches and gums. Galactomannan gums, particularly guar gum, have been preferred for this purpose. Such gums cause slurries to gel if employed in sufficiently high concentrations and cross-linking agents, such as borate and chromate salts or compounds of antimony or bismuth, may be added to accelerate gel formation.

During the manufacture of aqueous explosive slurries, it is desirable to thicken the ingredients early in the mixing process to prevent segregation. It has been found, however, that if the slurry is mixed or extruded into a casing after it has become quite thick or gelled, it tends to become desensitized, thus not being subject to easy or reliable detonation. Accordingly, a need exists for a thickener for aqueous explosive slurries which allows such slurries to be mixed or packaged subsequent to thickening without resulting in desensitization of the slurry.

SUMMARY OF THE INVENTION

It is an object of this invention to provide improved aqueous explosive slurries. Another object of the invention is to provide improved thickened aqueous explosive slurries of the type comprising an inorganic oxidizing salt, an organic or inorganic fuel, water and a thickening agent. A third object is to provide a method for making the improved aqueous slurry explosives of this invention. Other objects and advantages will become apparent to those skilled in the art from the disclosure herein.

In accordance with the invention, there is disclosed an improved thickened aqueous slurry explosive of the type containing an inorganic oxidizing salt, a fuel and water, wherein the improvement comprises a thickening amount of a colloidal hydrous metal oxide.

DETAILED DESCRIPTION OF THE INVENTION

In the practice of the present invention, the components of the explosive slurry are mixed together utilizing techniques known in the art. Generally, the sequence of addition of the slurry ingredients is not critical, however, as noted hereinbefore, mixing slurries after they have been thickened with galactomannan gums often results in desensitization. Generally, the oxidizing salt, which preferably comprises ammonium nitrate, or ammonium nitrite in admixture with sodium nitrate, is mixed with sufficient water to provide a fluid slurry. The water-oxidizing salt slurry may be thickened before or after the addition of the remaining slurry ingredients with a thickened amount of a colloidal hydrous metal oxide.

The colloidal hydrous metal oxide may be a substantially pure refined material such as finely divided alumina, silica gel or the like or may be a natural clay such as bentonite, attapulgite, or kaolin. Any such inorganic material which thickens aqueous solutions may be utilized in the explosive slurries of the present invention. Colloidal alpha alumina monohydrate is the preferred inorganic thickening agent of the present invention. Such material is commercially available, for instance, from Philadelphia Quartz Company under the trademark Dispal ® M Alumina.

The amount of colloidal hydrous metal oxide which is effective as a thickening agent varies with the particular material used, the composition of the aqueous slurry, and the viscosity desired. Generally, the amount used is sufficient to provide a viscosity of from about 6,000 cps to 20,000 cps preferably about 12,000 cps to 16,000 cps. If colloidal hydrous alumina is used, it has been found that a concentration of that material of from about 0.01 to 0.4 grams per ml of water is effective as a thickener. The preferred concentration of colloidal hydrous alumina is from about 0.04 to 0.08 grams per ml of water in the final product.

The viscosity of the aqueous slurry may be affected by factors other than the concentration of the colloidal hydrous metal oxide. For instance, pH and the concentration of dissolved electrolytes in the system may have an effect on viscosity. A pH range of from about 3 to 12, preferably about 4 to 8 provides suitable viscosities. The normal range of pH and electrolyte concentrations of conventional aqueous explosive slurries have not been found to be deleterious to the thickening effect of the colloidal hydrous metal oxides; however, since those factors may vary from one explosive composition to another, the concentration of the inorganic thickener necessary to impart the desired viscosity may also vary between such compositions.

The various remaining ingredients of the explosive slurry are preferably blended into the water-oxidizing salt slurry simultaneously with or subsequently to its thickening with the inorganic thickener. Generally, all of the ingredients are added simultaneously and blended until homogeneous. These ingredients are thus evenly dispersed throughout the slurry and maintained in that condition over extended periods of time. It has been found that mixing or filling the slurry subsequent to such thickening does not result in its desensitization.

As hereinbefore stated, such remaining ingredients advantageously include organic and inorganic fuels. Since the oxidizing salt is oxygen rich, generally, sufficient organic and inorganic fuels are used to provide a substantially oxygen-balanced system. Formulating oxygen-balanced slurries is within the ability of those skilled in the explosives art. Preferred organic fuels are ground coal, sugar, carbon black and nut meal or any combinations thereof. The preferred inorganic fuel is finely divided aluminum such as powdered or flake aluminum. Various optional ingredients, familiar to those skilled in the art may be employed in a slurry. Such ingredients may include an antacid, such as zinc oxide, calcium carbonate, etc., a stabilizer such as sodium thiosulfate, and additional sensitizers such as hollow glass or hollow resin microspheres.

Additionally, an explosive sensitizer, as hereinbefore described, may be incorporated into a slurry. The employment of such a sensitizer provides a product subject to easier detonation than a slurry without the sensitizer. Often, slurries containing a sensitizer may be detonated with a conventional blasting cap, whereas non-sensitized slurries usually require the use of an explosive booster for detonation. Nitrostarch may advantageously be employed when a sensitizer is employed.

Broadly defined, explosive slurries of the present invention advantageously comprise the following ingredients in the indicated ranges of concentration:

| | Non-Sensitized (wt %) | Sensitized (wt %) |
|---|---|---|
| Oxidizing Salt | 20–75% | 20–75% |
| Organic Fuel | 1–20% | 1–20% |
| Inorganic Fuel | 1–10% | 2–10% |
| Sensitizer | — | 10–50% |
| Water | 5–40% | 7–30% |
| Colloidal Hydrous metal oxide | 0.04–5% | 0.04–5% |

More specifically, preferred explosive slurries generally comprise the following ingredients.

| | Non-Sensitized (wt %) | Sensitized (wt %) |
|---|---|---|
| Ammonium Nitrate | 30–50% | 30–50% |
| Sodium Nitrate | 5–15% | 5–15% |
| Corn Sugar | 2–10% | 2–10% |
| Coal | 0.1–5% | 0.1–5% |
| Carbon Black | 0.01–2% | 0.01–2% |
| Aluminum | 2–7% | 2–7% |
| Hollow Glass Microspheres | 0.01–3% | 0.01–3% |
| Nitrostarch | — | 15–25% |
| Colloidal Alumina | 0.1–3% | 0.1–3% |
| Water | 10–30% | 10–30% |

In addition to a colloidal hydrous metal oxide thickener, the use of a galactomannan gum thickener may also be desirable. The use of a galactomannan gum thickener, particularly in conjunction with a suitable crosslinker provides a firm elastic, gelled product which is particularly appropriate for filling into elastic casings. The utilization of both types of thickeners in the same product provides for a method of manufacture which is advantageous over those used heretofore. That method of preparing explosive slurries comprises mixing an oxidizing salt, an organic fuel, an inorganic fuel, a thickening amount of a colloidal hydrous metal oxide and water thereby forming a homogeneous thickened mixture, then blending into said homogeneous thickened mixture a galactomannan gum and a crosslinker in amounts sufficient to gel said homogeous thickened mixture. The preferred components and their concentrations are generally the same as described above. The preferred galactomannan gum is guar gum. Any satisfactory crosslinker may be used to effect gellation of the slurry. Polyvalent inorganic salts, such as sulfate, nitrate, dichromate, or chloride salts of chromium, iron, aluminum, zinc, potassium, or tin or a water soluble pentavalent antimony compound, such as potassium pyroantimonate are effective crosslinkers. Preferred crosslinkers are potassium or zinc dichromate and potassium pyroantimonate. Generally, the amount of galactomannan gum sufficient to cause gellation of a slurry is from about 0.1–3 wt %, preferably from about 0.3 to 1 wt %. Amounts of galactomannan gum less than 0.1 wt % are generally insufficient to effect gellation and amounts in excess of 3 wt % provide little additional advantage. The crosslinker is usually employed at a concentration sufficient to cooperate with the galactomannan gum to effect gellation, e.g. at least about 0.05 wt %. Amounts of crosslinker in excess of about 2 wt % provide little additional advantage. The preferred concentration of crosslinker is from about 0.01–1 wt percent.

The above-described method of preparing an explosive slurry utilizing a colloidal hydrous metal oxide thickener and a galactomannan gum gelling agent is uniquely advantageous over prior art methods. After blending the explosive ingredients, water and the colloidal hydrous metal oxide, the ingredients are prevented from segregating by the thickening effect of the colloidal hydrous metal oxide. The slurry may be stored for extended periods of time until the preparer is ready to package it into casings or containers. At that time, the galactomannan gum and crosslinker are mixed into the slurry which can be packaged before gellation. The procedure allows optimum utilization of equipment and personnel, since the mixing and packaging steps can be accomplished at the location and time convenient to the manufacturer.

It is thus apparent that there have been provided thickened aqueous explosive slurries and methods for their preparation which satisfy the objects, aims and advantages set forth above. Although the invention has been described in conjunction with explosive slurries containing certain ingredients, it is not intended to be limited to such slurries, but is intended to broadly embrace all aqueous slurry explosives which fall within the spirit and broad scope of the appended claims.

The invention is further illustrated by the following examples, but is not intended to be limited thereby.

EXAMPLE I

An explosive slurry having the composition listed in Table I was prepared. The nitrate salts, nitrostarch, corn sugar, glass microspheres, zinc oxide, sodium thiosulfate, alumina and water were mixed for ten minutes. The mixture became thick and homogeneous. The aluminum, guar gum, zinc chromate and coal were added and the slurry was mixed for an additional ten minutes. The slurry was then filled into 2 inches × 16 inches polyethylene casings and was very thick one day after preparation. The slurry was sensitive to detonation with a standard A-3 blasting cap.

EXAMPLE II

The experiment of Example I was repeated in all essential details except for changes in the concentrations of ammonium nitrate, guar gum, and zinc chromate as indicated in Table I. The slurry was observed at room temperature and at 54° C and became very thick at both temperatures after ninety minutes. The slurry was sensitive to detonation with a standard A-1 blasting cap.

EXAMPLE III

The experiment of Example I was repeated in all essential details except the concentrations of ammonium nitrate, guar gum and zinc chromate were changed and the additional crosslinkers, potassium pyroantimonate and fumaric acid, were employed. The composition of the slurry is listed in Table I. The slurry was observed at 4.4° C, room temperature and 54° C. After ninety minutes, it was too thick to pour at 4.4° C and was thick but pourable at room temperature and 54° C. The slurry was sensitive to detonation with a standard A-1 blasting cap.

EXAMPLE IV

An explosive slurry having the following composition is prepared:

| | | |
|---|---|---|
| Ammonium Nitrate | 43.2 | wt % |
| Sodium Nitrate | 10 | wt % |
| Coal | 1 | wt % |
| Corn Sugar | 6 | wt % |
| Nitrostarch | 20 | wt % |
| Aluminum | 4.0 | wt % |
| Colloidal Alumina | 0.8 | wt % |
| Water | 15 | wt % |

The ingredients are mixed until a thick homogeneous slurry is obtained. The slurry is filled into 2 inches × 16 inches casings and is detonated with a conventional blasting cap.

EXAMPLE V

The experiment of Example IV is repeated in all essential details except silica gel is substituted for colloidal alumina. A thick homogeous slurry is obtained which is sensitive to detonation with a conventional blasting cap.

EXAMPLE VI

The experiment of Example IV is repeated in all essential details except finely divided bentonite is substituted for colloidal alumina. A thick homogeous slurry is obtained which is sensitive to detonation with a conventional blasting cap.

EXAMPLE VII

The experiment of Example IV is repeated in all essential details except finely divided attapulgite is substituted for colloidal alumina. A thick homogeous slurry is obtained which is sensitive to detonation with a conventional blasting cap.

EXAMPLE VIII

The experiment of Example IV is repeated in all essential details except finely divided kaolin is substituted for colloidal alumina. A thick homogeneous slurry is obtained which is sensitive to detonation with a conventional blasting cap.

Table I

| Ingredient | Example I (wt %) | Example II (wt %) | Example III (wt %) |
|---|---|---|---|
| Ammonium Nitrate | 36.0 | 36.7 | 36.7 |
| Sodium Nitrate | 10.0 | 10.0 | 10.0 |
| Ca/Mg Nitrate | 8.6 | 8.6 | 8.6 |
| Coal | 0.6 | 0.6 | 0.6 |
| Corn Sugar | 6.0 | 6.0 | 6.0 |
| Hollow Glass Microspheres | 1.0 | 1.0 | 1.0 |
| Nitrostarch | 16.9 | 16.9 | 16.9 |
| Zinc Oxide | 0.8 | 0.8 | 0.8 |
| Sodium Thiosulfate | 0.4 | 0.4 | 0.4 |
| Aluminum | 4.0 | 4.0 | 4.0 |
| Colloidal Alumina | 0.8 | 0.8 | 0.8 |
| Guar Gum | 1.0 | 0.4 | 0.25 |
| Zinc Chromate | 0.1 | 0.04 | 0.06 |
| Water | 13.8 | 13.8 | 13.8 |
| Potassium Pyroantimonate | — | — | 0.03 |
| Fumaric Acid | — | — | 0.015 |

We claim:

1. An improved thickened aqueous slurry explosive of the type containing an inorganic oxidizing salt, a fuel, and water, wherein the improvement comprises a thickening amount of a colloidal hydrous metal oxide.

2. The improved thickened aqueous slurry explosive of claim 1 wherein the colloidal hydrous metal oxide is employed in an amount sufficient to provide a viscosity of from about 6,000 cps to about 20,000 cps.

3. The improved thickened aqueous slurry explosive of claim 1 wherein the colloidal hydrous metal oxide is employed in an amount sufficient to provide a viscosity of from about 12,000 cps to about 16,000 cps.

4. The improved thickened aqueous slurry explosive of claim 2 wherein the colloidal hydrous metal oxide is colloidal alpha alumina monohydrate.

5. The improved thickened aqueous slurry explosive of claim 4 wherein the colloidal alpha alumina monohydrate is employed in the aqueous slurry explosive at a concentration of from about 0.04 wt % to about 5 wt %.

6. The improved thickened aqueous slurry explosive of claim 4 wherein the colloidal alpha alumina monohydrate is employed in the aqueous slurry explosive at a concentration of from about 0.1 wt % to about 3 wt %.

7. the improved thickened aqueous slurry explosive of claim 2 wherein the colloidal hydrous metal oxide is silica gel.

8. The improved thickened aqueous slurry explosive of claim 2 wherein the colloidal hydrous metal oxide is a natural clay.

9. The improved thickened aqueous slurry explosive of claim 8 wherein the natural clay is bentonite.

10. The improved thickened aqueous slurry explosive of claim 8 wherein the natural clay is attapulgite.

11. The improved thickened aqueous slurry explosive of claim 8 wherein the natural clay is kaolin.

12. the improved thickened aqueous slurry explosive of claim 2 further comprising a galactomannan gum and a crosslinker in amounts sufficient to gel the aqueous slurry explosive.

13. The improved thickened aqueous slurry explosive of claim 12 wherein said galactomannan gum is guar gum and said crosslinker is selected from the group consisting of sulfate, nitrate, dichromate and chloride salts of chromium, iron, aluminum, zinc, potassium and tin and potassium pyroantimonate.

14. The improved thickened aqueous slurry explosive of claim 12 wherein said guar gum is employed in the aqueous slurry explosive at a concentration of from about 0.1 to about 3 wt % and said crosslinker is employed at a concentration of from about 0.05 to about 2 wt %.

15. The improved thickened aqueous slurry explosive of claim 12 wherein said guar gum is employed in the aqueous slurry explosive at a concentration of from about 0.03 to about 1 wt % and said crosslinker is employed as a concentration of from about 0.1 to about 1 wt %.

16. A method for preparing an improved thickened aqueous slurry explosive, comprising mixing an oxidizing salt, an organic fuel, an inorganic fuel, water and a thickening amount of a colloidal hydrous metal oxide, thereby forming a homogeneous thickened mixture; then blending into said homogeneous thickened mixture a galactomannan gum and a crosslinker in amounts sufficient to gel said homogeneous thickened mixture.

17. The method of claim 16 wherein the colloidal hydrous metal oxide is employed in an amount sufficient that the viscosity of the homogeneous thickened mixture is from about 6,000 cps to about 20,000 cps, the galactomannan gum in guar gum and the crosslinker is selected from the group consisting of sulfate, nitrate, dichromate chloride salts of chromium, iron, aluminum, zinc, potassium, and tin and potassium pyroantimonate.

18. The method of claim 16 wherein the colloidal hydrous metal oxide is employed in an amount sufficient that the viscosity of the homogeneous thickened mixture is from about 12,000 cps to about 16,000 cps, the galactomannan gum is guar gum and the crosslinker is potassium pyroantimonate.

19. The method of claim 17 wherein the colloidal hydrous metal oxide is colloidal alpha alumina monohydrate.

20. The method of claim 19 wherein the colloidal alpha alumina monohydrate is employed at a concentration of from about 0.04 wt % to about 5 wt %, the guar gum is employed at a concentration of from about 0.1 wt % to about 3 wt %, and the crosslinker is employed at a concentration of from about 0.05% to about 2 wt %.

21. The method of claim 19 wherein the colloidal alpha alumina monohydrate is employed at a concentration of from about 0.1 wt % to about 3 wt %, the guar gum is employed at a concentration of from about 0.3 wt % to about 1 wt %, and the crosslinker is employed at a concentration of from about 0.1 wt % to about 1 wt %.

22. The method of claim 17 wherein the colloidal hydrous metal oxide is silica gel.

23. The method of claim 17 wherein the colloidal hydrous metal oxide is a natural clay.

24. The method of claim 23 wherein the natural clay is bentonite.

25. The method of claim 23 wherein the natural clay is attapulgite.

26. The method of claim 23 wherein the natural clay is kaolin.

* * * * *